US007191696B2

(12) United States Patent
Morr et al.

(10) Patent No.: US 7,191,696 B2
(45) Date of Patent: Mar. 20, 2007

(54) ROTARY ACTUATOR ASSEMBLY

(75) Inventors: Glen A. Morr, Churubusco, IN (US); Larry E. Keeling, Jr., Fort Wayne, IN (US)

(73) Assignee: PHD, Inc., Fort Wayne, IN (US)

( * ) Notice: Subject to any disclaimer, the term of this patent is extended or adjusted under 35 U.S.C. 154(b) by 0 days.

(21) Appl. No.: 11/337,139

(22) Filed: Jan. 20, 2006

(65) Prior Publication Data

US 2006/0112820 A1 Jun. 1, 2006

Related U.S. Application Data

(63) Continuation of application No. 10/620,526, filed on Jul. 16, 2003, now Pat. No. 6,988,440.

(60) Provisional application No. 60/396,602, filed on Jul. 18, 2002.

(51) Int. Cl.
*F01B 9/00* (2006.01)

(52) U.S. Cl. ..... 92/137; 74/108

(58) Field of Classification Search ..... 92/2, 92/137; 74/108

See application file for complete search history.

(56) References Cited

U.S. PATENT DOCUMENTS 3,448,626 A * 6/1969 Yeatman et al. ..... 92/137
4,699,556 A * 10/1987 Foulke ..... 74/108
5,117,739 A * 6/1992 Maher et al. ..... 92/2

* cited by examiner

*Primary Examiner*—F. Daniel Lopez
(74) *Attorney, Agent, or Firm*—Barnes & Thornburg LLP

(57) ABSTRACT

A rotary actuator assembly is provided. The assembly has a flexible member that is attached to a piston for linear movement. The flexible member is also attached to a pinion for pivotable movement.

15 Claims, 10 Drawing Sheets

ROTARY ACTUATOR ASSEMBLY

RELATED APPLICATIONS

The present application is a Continuation of U.S. patent application Ser. No. 10/620,526, filed on Jul. 16, 2003 now U.S. Pat. No. 6,988,440, entitled Rotary Actuator Assembly. The present application is related to and claims priority to U.S. Provisional Patent Application Ser. No. 60/396,602, filed on Jul. 18, 2002, entitled Cable Rotary. The subject matter disclosed in that provisional application is hereby expressly incorporated into the present application.

TECHNICAL FIELD

The present invention relates to rotary actuator assemblies and, more particularly, to rotary actuators assemblies that translate linear movement into rotational movement.

BACKGROUND AND SUMMARY

Rotary actuator assemblies are generally known to those skilled in the art. Rotary actuators are useful in combination with grippers, slides, or other devices that require rotational movement in addition to their function. One type of rotary actuator includes a vane that swings in response to air pressure exerted thereon, to rotate a body. Another type of rotary actuator uses a rack and pinion assembly, wherein an actuator engages the rack, which in turn engages the pinion. Linear motion of the rack causes the pinion to rotate. Moving the rack reciprocally causes similar reciprocal rotation of the pinion. In contrast to the vane-type actuator, the rack and pinion embodiment translates linear motion of the rack into rotational movement of the pinion. It is known in the art, however, that conventional rotary actuator designs tend to be structurally complex and expensive to produce.

It would, therefore, be desirable to provide a rotary actuator assembly of alternate configuration to perform the above-described and other functions typical of rotary actuator assemblies.

Accordingly, an illustrative embodiment of the present invention provides a rotary actuator assembly which comprises an actuator, at least one piston, a longitudinally-extending flexible member, a set and a pinion. The piston is movable in response to the actuator. The flexible, longitudinally-extending member is attached to the piston. The set is attached to the flexible member. The pinion is engagable with the set such that when the flexible member moves, so too does the pinion.

In the above and other illustrative embodiments, the rotary actuator assembly may also provide: the actuator being pneumatic; movement of the pinion being rotational; the flexible member conforming to a portion of the pinion; the flexible member being a cable; a piston being attached to opposed portions of a cable; the set being a bearing; a pinion comprising a cavity to receive a bearing and a pathway to receive at least a portion of a cable; movement of the piston being linear and movement of the pinion being arcuate; movement of the pinion being rotational; a stop being engagable with a pinion to limit its movement; a seal located between a set and a piston; a flexible member being disposed through a seal; a portion of the seal forming a seal between itself and the flexible member when the piston moves in response to an actuator; an adjustable member being selectively movable relative to a pinion and engagable with the same; and an adjustable member being engagable with a stop to prevent backlash on a set and pinion.

Another illustrative embodiment of the present invention provides a rotary actuator assembly which comprises an actuator, a longitudinally-extending, flexible member, and a pinion. The longitudinally-extending, flexible member moves linearly in response to the actuator. The pinion engages the flexible member, wherein linear movement of the flexible member translates into rotational movement of the pinion.

In the above and other illustrative embodiments, the rotary actuator assembly may also provide: a flexible member comprising a fastener attached thereto which engages a pinion to cause the pinion to pivot; an actuator being pneumatic; a piston being attached to opposed portions of a flexible member; a fastener being a bearing; a pinion comprising a cavity to receive the bearing and a pathway to receive at least a portion of a flexible member; a stop engagable with the pinion to limit movement of the same; a seal located between a fastener and a piston; a flexible member being disposed through a seal; a portion of a seal forming a seal between itself and the flexible member when a piston moves in response to an actuator; an adjustable member that is selectively movable relative to the pinion and engagable with same; and an adjustable member being engagable with a stop to prevent backlash on a bearing and the pinion.

Another illustrative embodiment of the present invention provides a rotary actuator assembly which comprises a housing, a pinion, a cable, a first piston and a second piston. The pinion is located in the housing, wherein the pinion is rotatable relative to the same. At least a portion of the cable is disposed in the housing and is circumferentially engagable with the pinion. The first piston is engagable with one end of the cable, and the second piston engagable with another end of the cable. The first and second pistons are movable linearly to cause the pinion to rotate.

In the above and other illustrative embodiments, the rotary actuator assembly may also provide: first and second pistons being disposed in first and second chambers, respectively, and wherein fluid is deposited in the first and second chambers to move the first and second pistons linearly; pistons moving linearly in alternate directions within the chambers; at least a portion of the cable being attached to the pinion so alternate linear movement of the pistons translates into alternate rotational movement of the pinion; a cable wraps around a portion of the pinion; and a fastener attaches a cable to the pinion.

Another illustrative embodiment of the present invention provides a rotary actuator assembly which comprises a selectively rotatable body, a flexible, longitudinally-extending means and an actuation means. The flexible, longitudinally-extending means engages and selectively rotates the rotatable body. The actuation means moves the flexible longitudinal extending means to rotate the rotatable body.

Additional features and advantages of the rotary actuator assembly will become apparent to those skilled in the art upon consideration of the following detailed description of the illustrated embodiment exemplifying the best mode of carrying out the rotary actuator assembly as presently perceived.

BRIEF DESCRIPTION OF DRAWINGS

The present disclosure will be described hereafter with reference to the attached drawings which are given as non-limiting examples only, in which.

Figure 1:
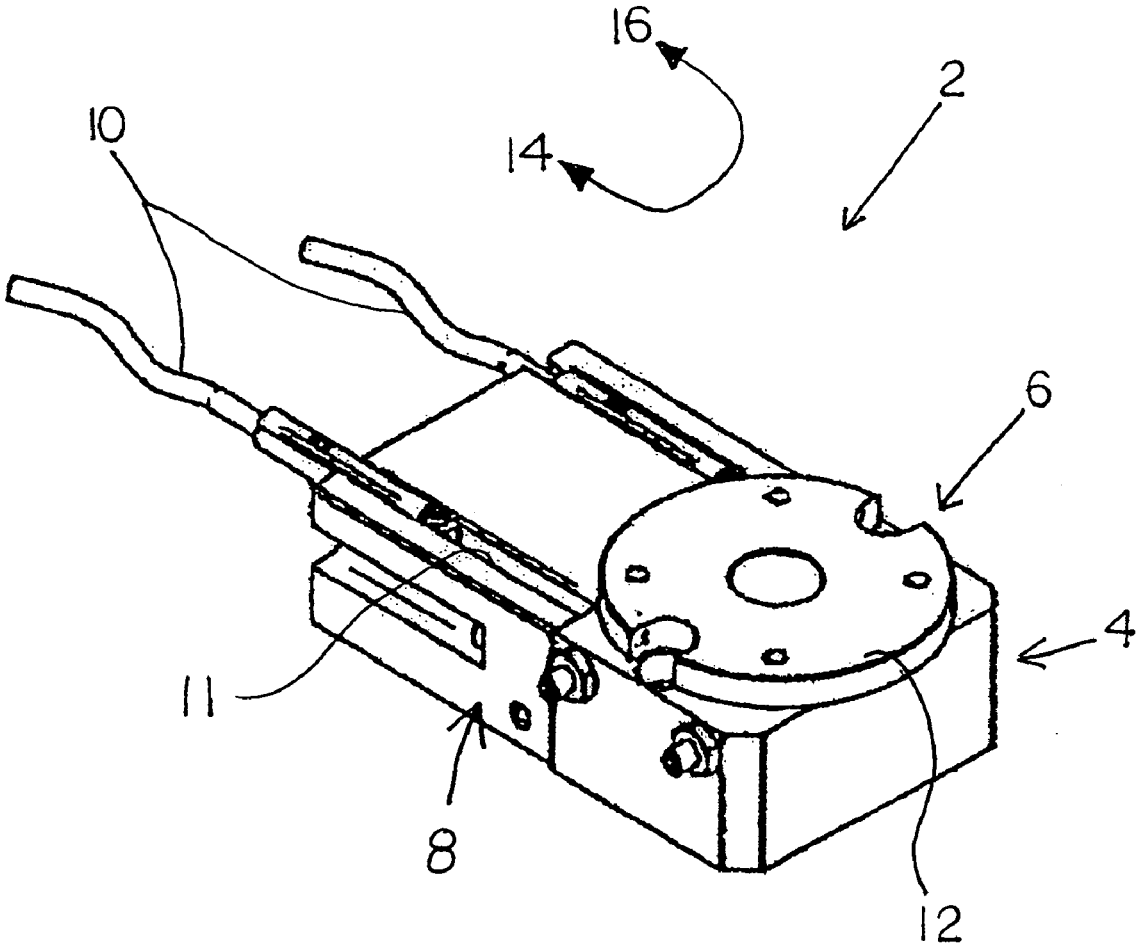
FIG. 1 is a perspective view of an illustrative rotary actuator assembly.

Corresponding reference characters indicate corresponding parts throughout the several views. The exemplification set out herein illustrates various embodiments of the rotary actuator assembly, and such exemplification is not to be construed as limiting the scope of the rotary actuator assembly in any manner.

DETAILED DESCRIPTION OF THE DRAWINGS

A perspective view of an illustrative rotary actuator assembly 2 is shown in FIG. 1. The illustrative assembly 2 comprises a body assembly 4, a pinion assembly 6 disposed in body assembly 4, and a cap assembly 8 attached to body assembly 4. It is contemplated that the pinion assembly 6 can be driven by any numerous means, including hydraulic or electrical, for example. In this illustrative embodiment, however, assembly 2 is driven by means of pneumatic actuation. Sensors 10 are also shown in this view which detect the presence of structures inside cap assembly 8. The sensors 10 are located in channels 11 of assembly 8.

Figures 2, 3:
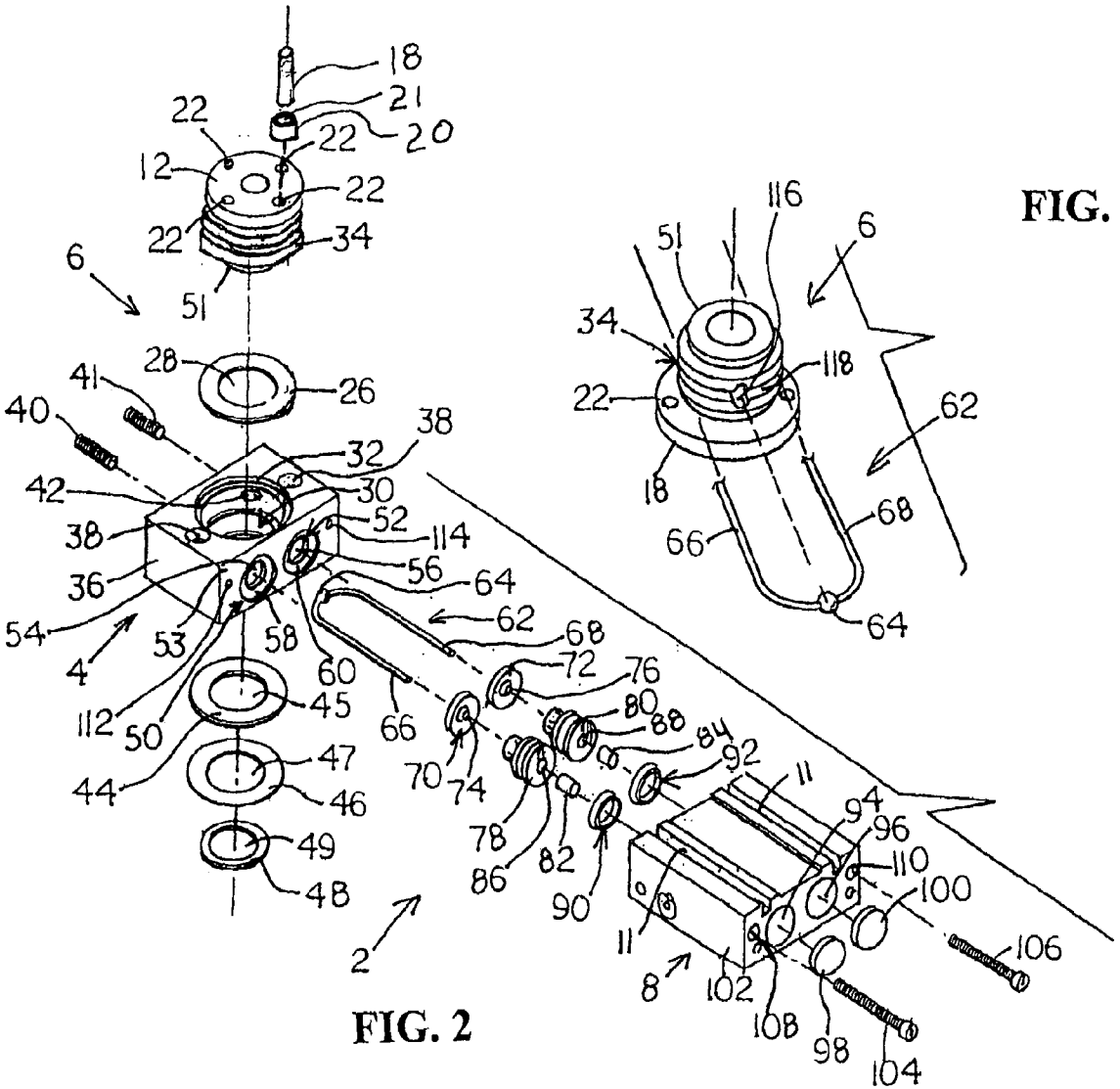
FIG. 2 is an exploded view of an illustrative rotary actuator assembly.
FIG. 3 is an exploded detail view of a portion of the rotary actuator assembly.

FIG. 2 is an exploded view of the illustrative embodiment of rotary actuator assembly 2 showing the illustrative sub-assemblies. The body assembly 4, pinion assembly 6, and cap assembly 8 are all shown in exploded view as well. Pinion assembly 6 comprises a stop pin 18 that is disposed in bore 22 and extends downwardly from base 12. Bores 22 can be disposed through base 12 at various locations to provide a plurality of stopping options for base 12. A pad 20, having a bore 21 disposed therethrough, receives stop pin 18 on the portion that extends from base 12. Accessory mounts (not shown) can be disposed in base 12 and configured to receive accessories, such as a gripper assembly or a slide assembly, for example. (See FIGS. 11–14.) It is appreciated that the base 12 can be configured in any manner to receive any structure or structures that is desired to be rotated by pinion assembly 6. Mounts 38 are disposed in body 36 so as to allow assembly 2 to be attached to another structure for any of a variety of utilitarian purposes known to those skilled in the art.

A bore 30 is disposed through body 36. A pinion 34 depends from base 12 and is disposed through the opening 28 of a bearing 26 and into bore 30. An illustrative countersink 32 is located at the periphery of bore 30 to receive bearing 26. The bearing helps prevent debris and other contaminants from entering bore 30, and provides axial and radial support for the pinion.

Adjustment screws 40 and 41 are illustratively disposed in body 36 through bores 39 and 42. (See, also, FIGS. 6–8.) Adjustment screws 40 and 41 extend into bore 30 and are configured to engage pad 20 and stop pin 18 to limit the travel of pinion 34. The adjustment screws 40 and 41 are movable within bore 30 to affect the stop position of pinion 34. (See, also, FIGS. 7 and 8.) It is appreciated that the positioning of the adjustment screws 40 and 41, as shown in FIG. 2, is for illustrative purposes. It is appreciated that the locations of the bores can be at any position desired along body 36.

In this illustrative embodiment, bore 30 is disposed completely through body 36. It is appreciated, however, that this is not a requirement for the invention to be operable. In this illustrative embodiment, pinion 34 is received in hole 45 of thrust bearing 44. A washer 46 is located adjacent thrust bearing 44 and also has a hole 47 that, too, receives pinion 34. A retainer 48 is located adjacent washer 46 and has a hole 49 to receive pinion 34. The retainer 48 illustratively "snap-fits" to portion 51 of pinion 34 to maintain pinion assembly 6 with body 36. These washers and retainers, however, allow the pinion assembly 6 to effectively pivot with respect to body 36.

Body 36 also comprises ports 50 and 52 which are disposed therethrough. Holes 54 and 56 of ports 50 and 52, respectively, are disposed through body 36, extending from the periphery of surface 53 and into bore 30. In the illustrative embodiment, countersinks 58 and 60 are disposed about holes 54 and 56, respectively. A flexible member or cable 62 is provided which forms partially around pinion 34 in an illustrative U-shape pattern and is disposed through ports 50 and 52. In this illustrative embodiment, flexible member 62 is an "aircraft-quality" cable, having a set or bearing 64 attached thereto. Aircraft-quality cable is used because of its known high strength properties. It is appreciated, however, that other cables, bands, urethane cable, nylon or plastic member, structures, or materials can be used in place of aircraft cable, so long as it can form partially around at least a portion of pinion 34 and drive the same.

The cable 62 is attached to pinion 34 via a fastener, or as shown in FIGS. 2 and 3, a set or bearing 64. Bearing 64 is crimped onto or otherwise affixed to cable 62. It is appreciated that any structure or means that affixes at least one point or a portion of the cable 62 to pinion 34 can be used in place of the set or bearing 64.

In the illustrated embodiment, a first portion 66 of cable 62 is disposed through port 50, and a second portion 68 is disposed through port 52. (See, also, FIGS. 4 and 5.) First and second portions of cable 62 are disposed through locating seals 70 and 72, respectively. Each of the locating seals 70 and 72 have a hole 74 and 76 disposed therethrough to receive the first and second cable portions 66 and 68, respectively. It is appreciated that locating seals 70 and 72 are fitted in the countersink portions 58 and 60 of ports 50 and 52, respectively.

Figures 16, 17, 18:
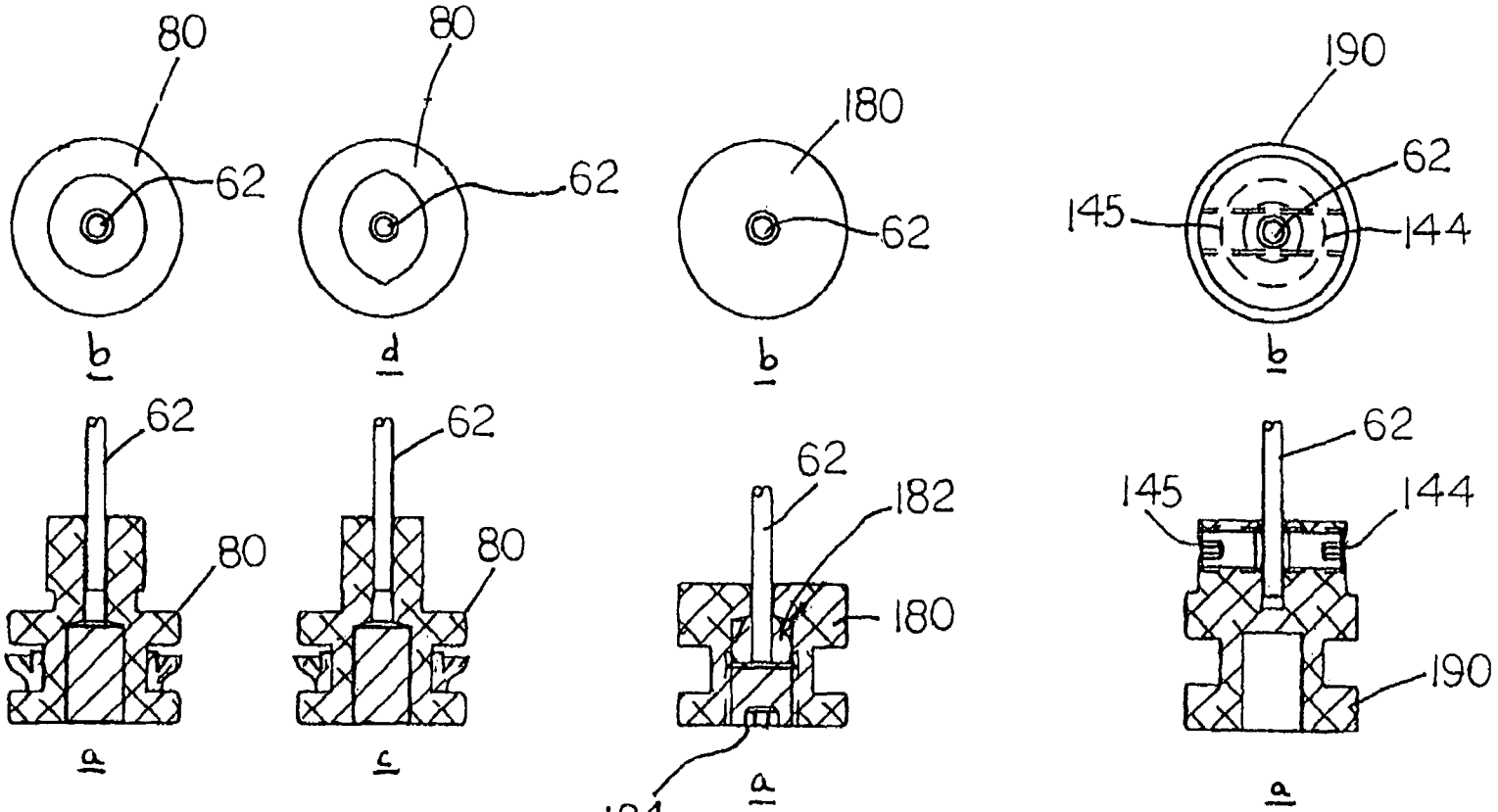
FIGS. 16*a* through *d* are cross-sectional and end views of an illustrative piston assembly portion of the rotary actuator assembly.
FIGS. 17*a* and *b* are cross-sectional and end views of another illustrative piston assembly portion of the rotary actuator assembly.
FIGS. 18*a* and *b* are cross-sectional and end views of another illustrative piston assembly portion of the rotary actuator assembly.

First and second portions 66 and 68 of cable 62 are fitted illustratively in pistons 78 and 80, respectively. It is contemplated that cable 62 can be attached to the pistons in any conventional manner, including set screws, pinched, adhesive, etc. (See FIGS. 16–18.) Accordingly, in this illustrative embodiment, as pistons 78 and 80 are caused to move, the cable 62 attached thereto moves correspondingly as well. This movement results in pinion 34 moving.

Targets 82 and 84 can be fitted in bores 86 and 88 disposed in pistons 78 and 80, respectively. Targets 82 and 84 can be magnets, for example, to be used in conjunction with sensors 10 for locating the position of pistons 78 and 80 inside cap assembly 8. (See FIG. 1.) Piston seals 90 and 92 are disposed about the periphery of pistons 78 and 80, respectively. (See, also, FIGS. 4 and 5.) In this embodiment, cable 62, along with pistons 78 and 80, targets 82 and 84, and piston seals 90 and 92, are disposed within chambers 94 and 96, respectively. The pistons travel linearly through chambers 94 and 96 to create the linear movement that will be converted into rotational movement of pinion 34. Cap 102 of cap assembly 8 is attached to body assembly 4 via bolts or fasteners 104 and 106. The fasteners 104 and 106 extend through bores 108 and 110 which are disposed through cap 102 and coaxial to bores 112 and 114. The bores 112 and 114 are threaded to receive fasteners 104 and 106, thereby securing cap assembly 8 to body assembly 4.

A reverse-exploded detail view of pinion assembly 6 is shown in FIG. 3. In this illustrative embodiment, a cavity 116 is disposed through pinion 34 to receive bearing 64. It is appreciated that the specific bearing 64 shown in these embodiments is for illustrative purposes only. Specifically, coupling only a portion of cable 62 to pinion 34 allows the cable to wrap around a portion of pinion 34 to translate the linear motion caused by pistons 78 and 80 into rotational motion of pinion 34. Extending from cavity 116 is a pathway 118. First and second portions 66 and 68, respectively, of cable 62 are located in at least a portion of pathway 118. In this embodiment, the pathway 118 is a slot disposed about the periphery of pinion 34. It is contemplated that other structures, such as sets, fasteners, pins and the like, could be used in place of bearing 64 shown. The utility of such a structure is to attach a portion of cable 62 to pinion 34 so that as cable 62 moves, so too does pinion 34. The bearing is used in this illustrative embodiment because of the relative ease in providing a cavity 116 for it, thereby creating the requisite attachment.

Figure 5:
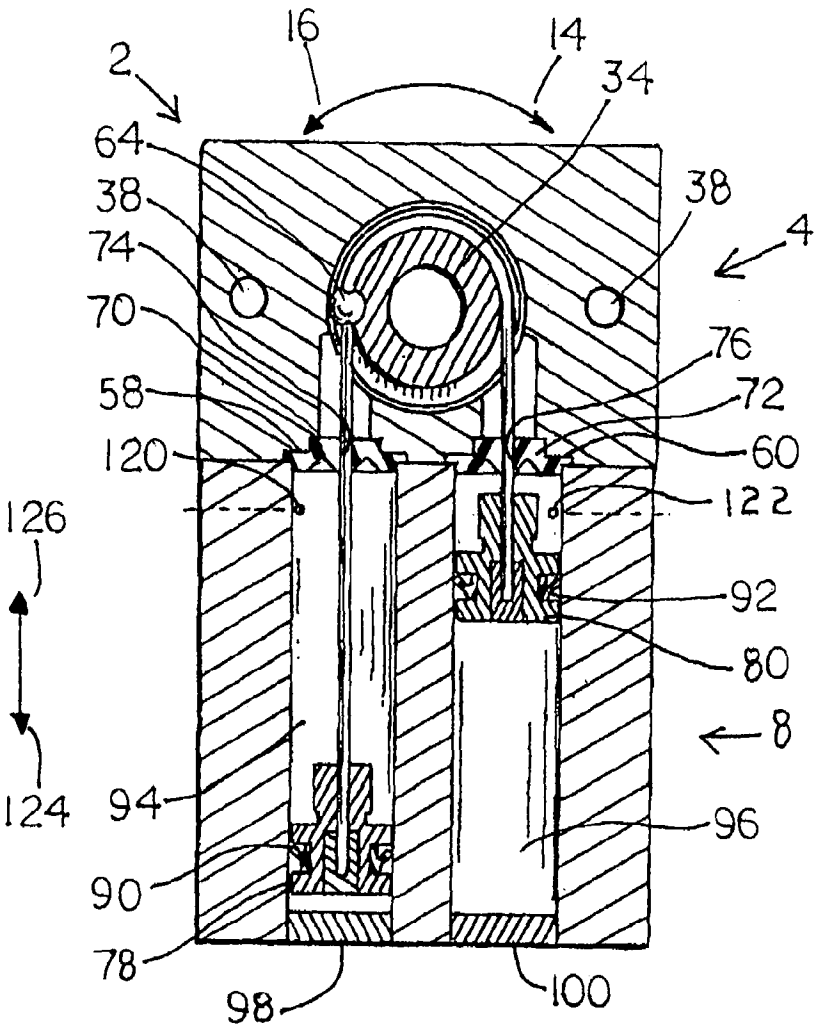
FIGS. 4 and 5 are top cross-sectional views of the rotary actuator assembly taken along lines A—A of FIG. 11.
Figure 4:
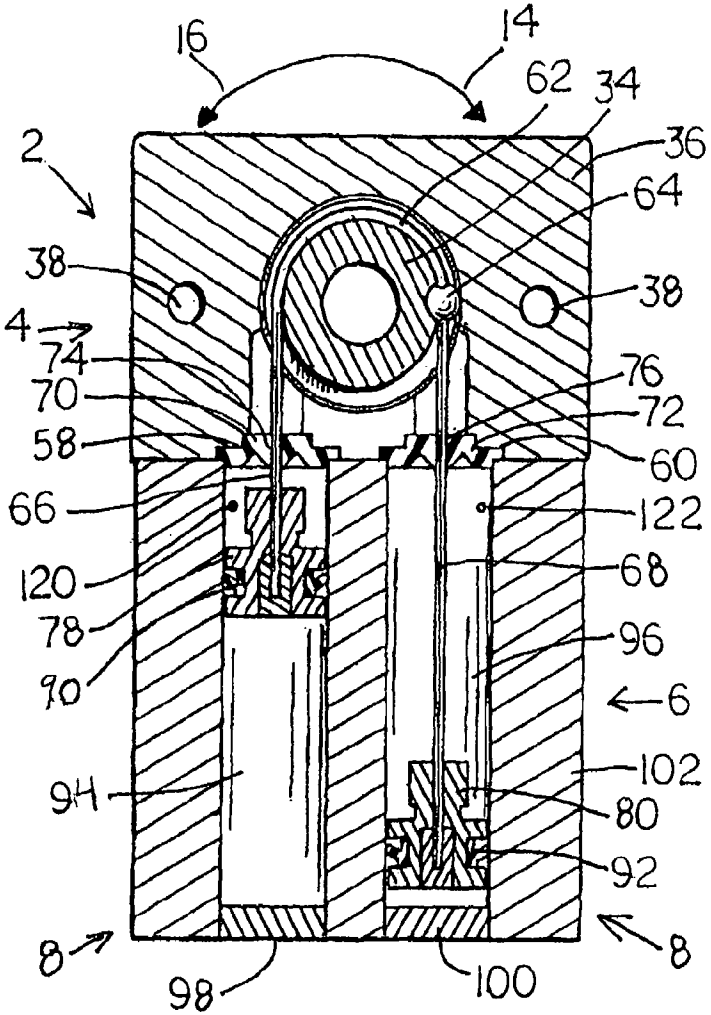

Top cross-sectional views of assembly 2 are shown in FIGS. 4 and 5. These views show the result of the actuation and movement of pistons 78 and 80 in alternate linear directions 124 and 126, causing the pinion 34 to rotate in directions 14 and 16. For example, as shown in FIG. 4, when air is provided through port 122 and into chamber 96, piston 80 is caused to move in direction 124. As this occurs, the second portion 68 of cable 62 is caused to extend farther into chamber 96. Because bearing 64 engages pinion 34 as cable 62 moves, pinion 34 moves as well. With the cable 62 wrapped around the periphery of pinion 34, and held by bearing 64 and cavity 116, the movement made by pinion 34 is rotational in direction 14. Thus, the linear movement of piston 80 causes the rotational movement of pinion 34.

FIG. 5 shows the reverse movement of pinion 34 from that shown in FIG. 4. In this case, fluid enters chamber 94 from port 120, causing piston 78 to move in direction 124. This causes first portion 66 of cable 62 to extend farther into chamber 94, thereby causing the attached pinion 34 to rotate in direction 16. Note that as the first portion 66 moves in direction 124, second portion 68 and piston 80 are caused to move in direction 126. By alternatively supplying fluid to chambers 94 or 96, a reciprocated rotational movement of pinion 34 in directions 14 and 16 occurs.

Figure 6:
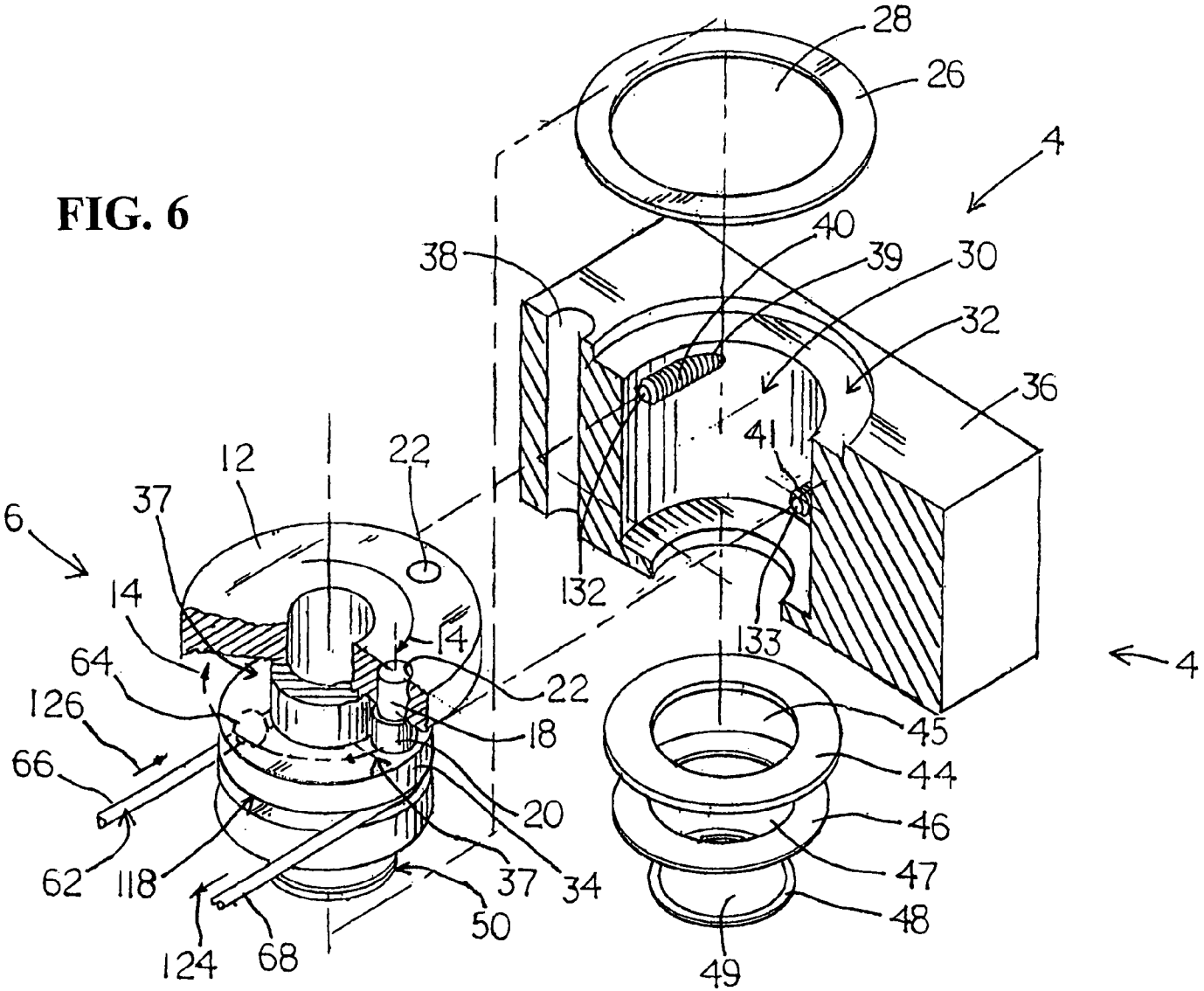
FIG. 6 is a perspective exploded detail view of a portion of the rotary actuator assembly.

An exploded view of body assembly 4 is shown in FIG. 6. This view shows the relationship between the stop pin 18 and the adjustment screws 40 and 41. In this illustrative embodiment, pinion 34 is rotated in direction 14 by movement of the second portion 68 of cable 62 moving in direction 124. Pad 20 receives stop pin 18, and is located in a channel 37 formed between base 12 and pinion 34. Pad 20 will engage the tip 132 of adjustment screw 40 after a particular amount of rotation is reached. The amount of movement that can be achieved before being stopped by adjustment screw 40 is contingent upon how far adjustment screw 40 is selectively disposed within bore 30, or not. By doing this, flexibility is given to the amount of rotational movement possible by pinion 34. For example, the less adjustment screw 40 is extended to bore 30, the more pinion 34 will rotate in direction 14. In contrast, the farther adjustment screw 40 is extended into bore 30, the less pinion 34 will rotate in direction 14.

Figure 15:
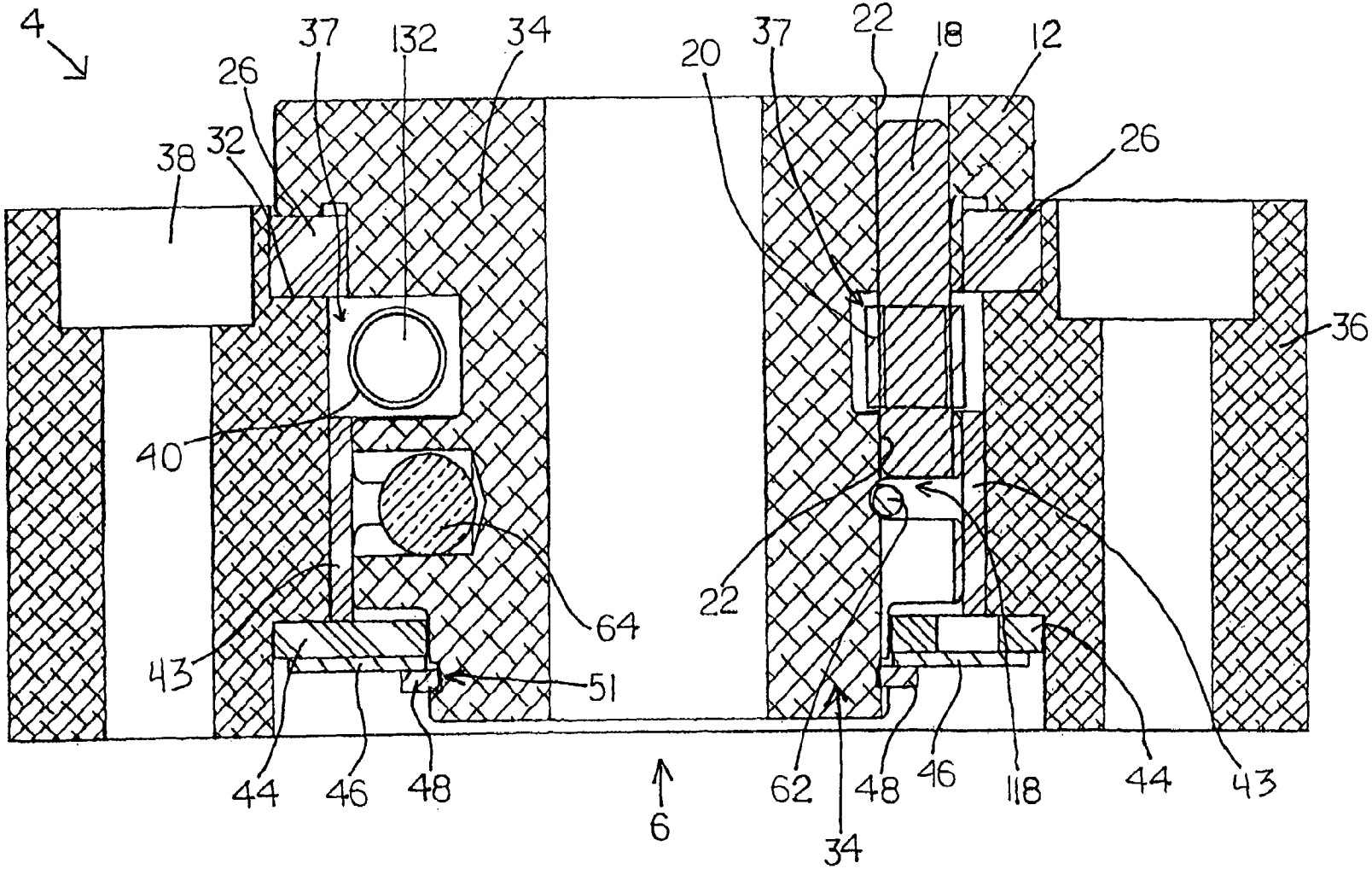
FIG. 15 is a cross-sectional view of the body assembly portion of the rotary actuator assembly.

A cross-sectional view of body assembly 4 is shown in FIG. 15. This view, in particular, shows the stop pin 18 extended through bore 22 which is disposed through base 12 and pinion 34. Pad 20 is shown positioned within channel 37 and aligned with tip 132 of adjustment screw 40. This alignment allows engagement between tip 132 and pad 20. This view also shows pinion assembly 6 in an assembled condition depicting the positional relationship between washer 46 and bearings 26 and 44, and retainer 48 with pinion 34. A bearing surface 43 is positioned between pinion 34 and the surface of bore 30. Surface 43 can be made of any bearing material including polymers and/or liquid lubricants. It is appreciated, however, that the contacting surfaces between pinion 34 and bore 30, can themselves, be bearing surfaces.

Figure 8:
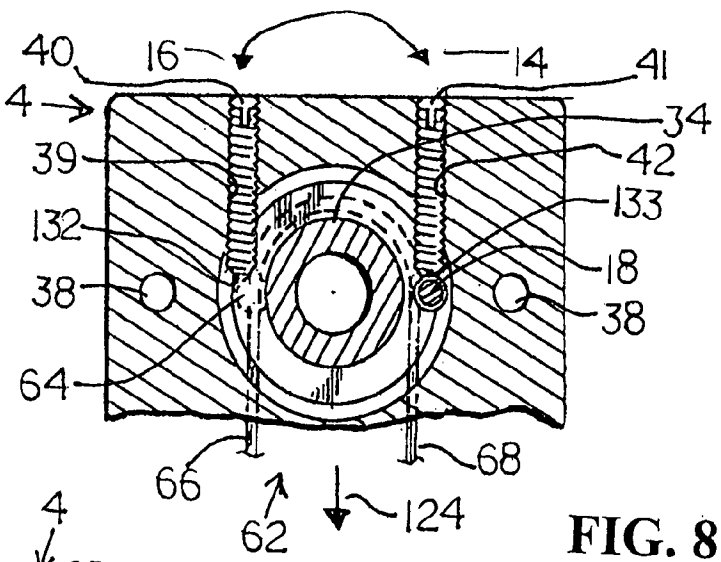
FIGS. 7 and 8 are cross-sectional detail views of the body of the rotary actuator assembly.
Figure 7:
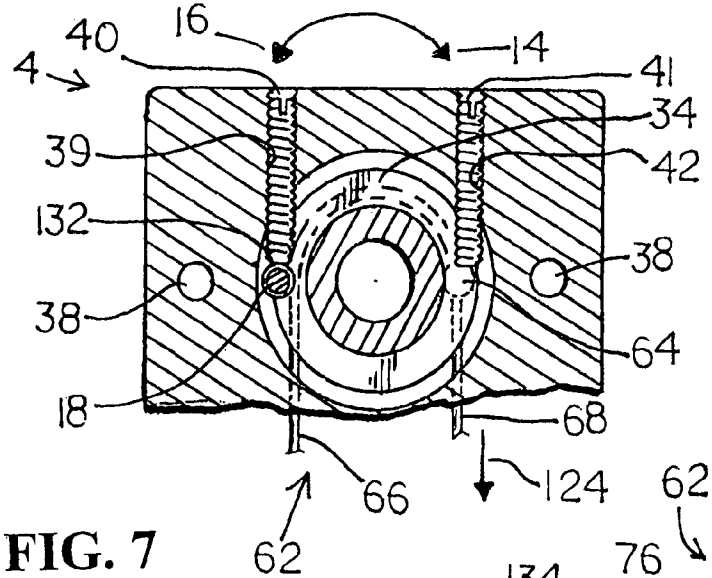

FIGS. 7 and 8 demonstrate the capability of stop pin 18 in relationship to adjustment screws 40 and 41. As shown specifically in FIG. 7, movement of the second portion 68 of cable 62 in direction 124 to move pinion 34 in direction 14 causes stop pin 18 to engage tip 132 of adjustment screw 40, thereby limiting movement of pinion 34 during that stroke. Conversely, moving first portion 66 of cable 62 in direction 124 to move pinion 34 in direction 16 causes stop pin 18 to engage tip 133 of adjustment screw 41 as well.

Figure 9:
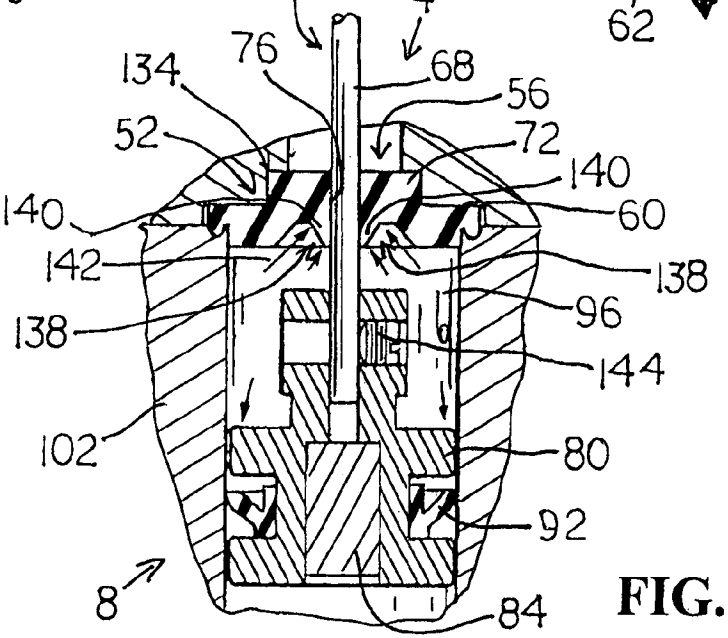
FIG. 9 is a cross-sectional view of a portion of the cap assembly of the rotary actuator assembly including a piston and seal.

A detailed sectional view of a portion of body assembly 4 and cap assembly 8 is shown in FIG. 9. In this illustrative embodiment, locating seal 72 is shown as a barrier between assembly 4 and assembly 8. This provides a seal between chamber 96 and bore 30 to prevent fluid or air from leaking out. Another illustrative function of seal 72 is to provide a seal between itself and cable 62 when piston 80, for example, is energized. In this illustrative embodiment, a channel 138 is disposed near the periphery of hole 76. A rise 140, however, is formed between the channel 138 and hole 76 such that as chamber 96 is pressurized, the pressure from the fluid directing piston 80 in direction 124 also exerts forces 142 within channel 138 and against rise 140. The forces 142 cause rise 140 to push inward against second portion 68 of cable 62, thereby providing the requisite seal. Also shown in FIG. 9 is set screw 144 that is disposed in piston 80 to attach second portion 68 to piston 80. It is appreciated, however, that attachment of cable 62 to the pistons 78 and 80 can be achieved by any variety of means as known by those skilled in the art. This includes crimping the end of piston 80 around cable 62, as shown in FIGS. 16*a* through *d*. In this illustrated embodiment, FIGS. 16*a* and *b* are views of cable 62 inserted into piston 80 prior to crimping. FIGS. 16*c* and *d* are views of piston 80 crimped onto cable 62. Alternatively, FIGS. 17*a* and *b* shows two views of a piston 180 and cable 62, wherein a slug 182 is attached to the end of cable 62. The slug 182 is deformed around the cable, and set screw 184 engages the same within piston 180. FIGS. 18*a* and *b* show a design arrangement similar to that shown in FIG. 9, with the exception of an additional set screw 145 disposed in piston 190 along with to set screw 144 to attach cable 62 to the piston.

Figure 10:
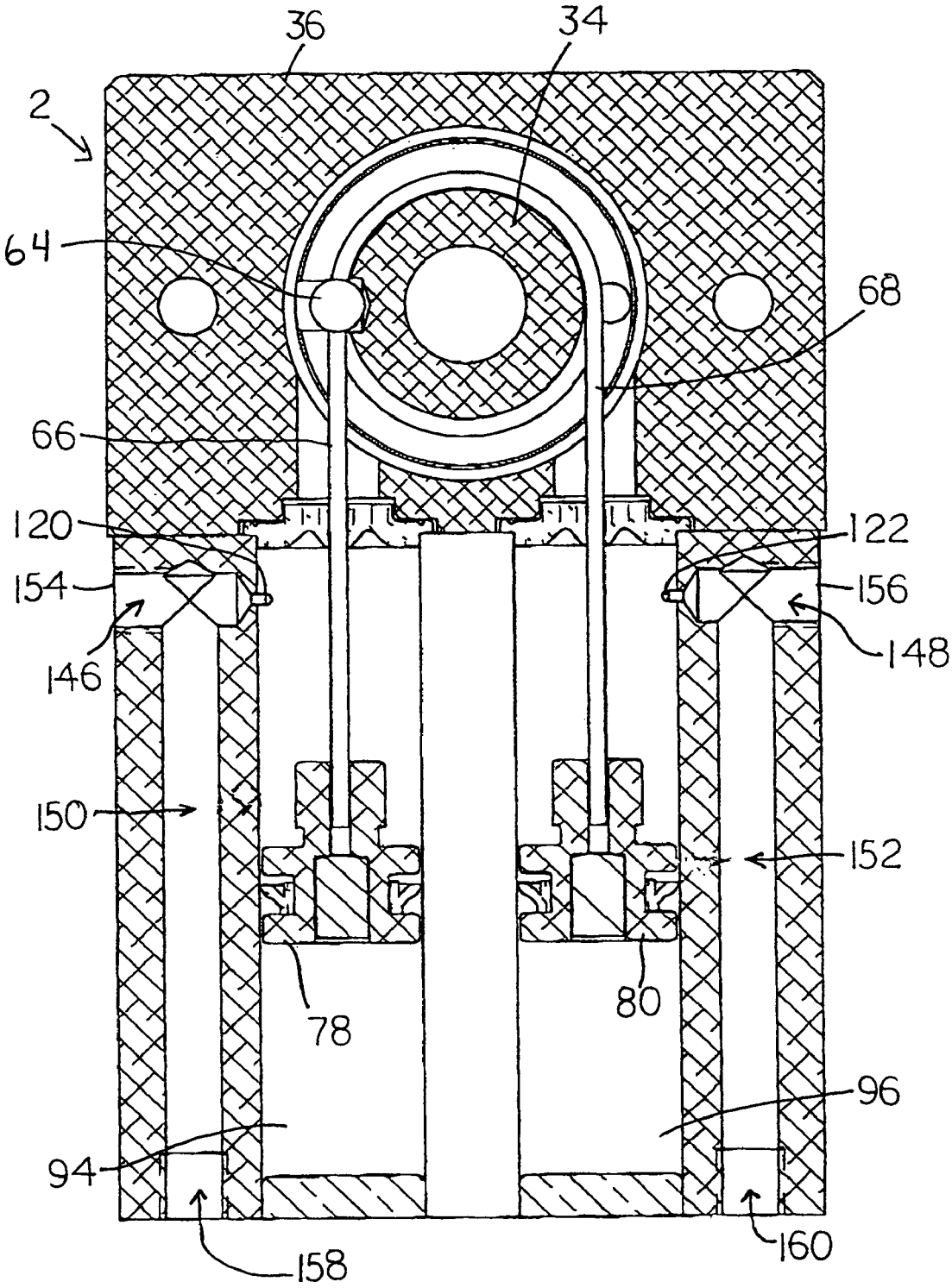
FIG. 10 is a cross-sectional view of the rotary actuator assembly taken along lines B—B of FIG. 11.

FIG. 10 is a top cross-sectional view of rotary actuator assembly 2. This view shows the passage ways for ports 120 and 122 that provide the fluid to actuate pistons 78 and 80. In this illustrative embodiment, fluid can be disposed into either chambers 94 or 96 via passage ways 146, 150 and 148, 152, respectively. This is to accommodate the various environments and orientations such a rotary actuator may be placed in. Fluid-providing tubes 164 and 166 may engage openings 154 or 156. Alternatively, such tubes may engage openings 158 or 160. (See FIGS. 11 and 12.)

Figure 11:
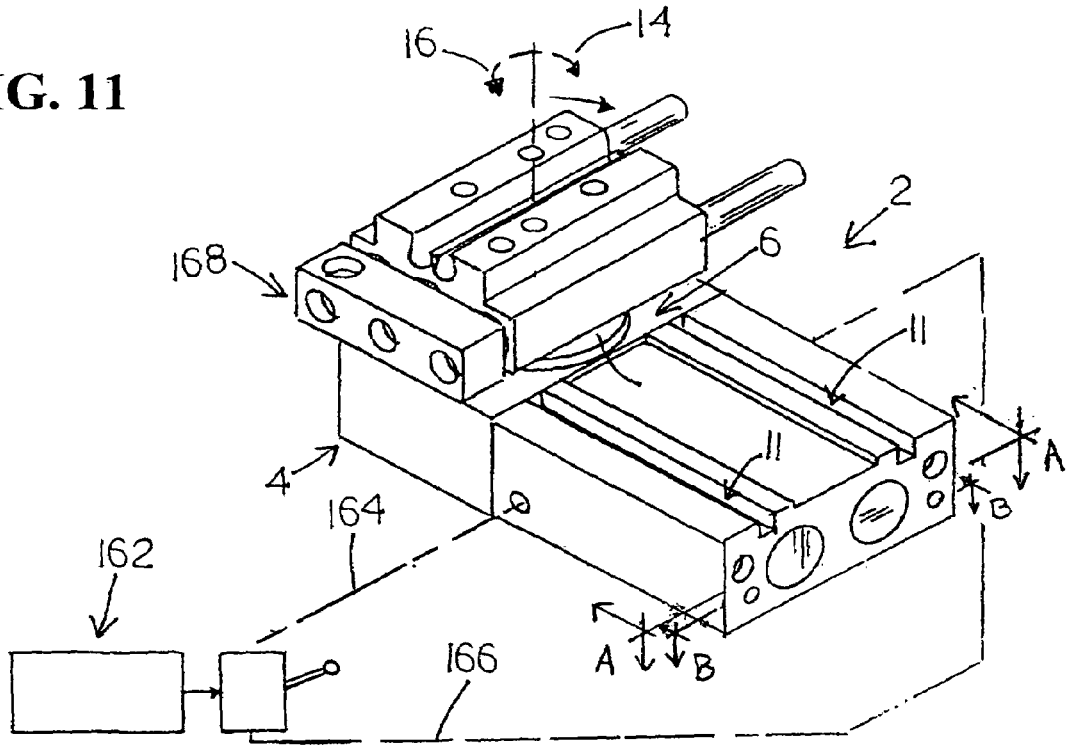
FIGS. 11 and 12 are perspective views of a rotary actuator assembly demonstrating illustrative utilities including a slide assembly.
Figure 12:
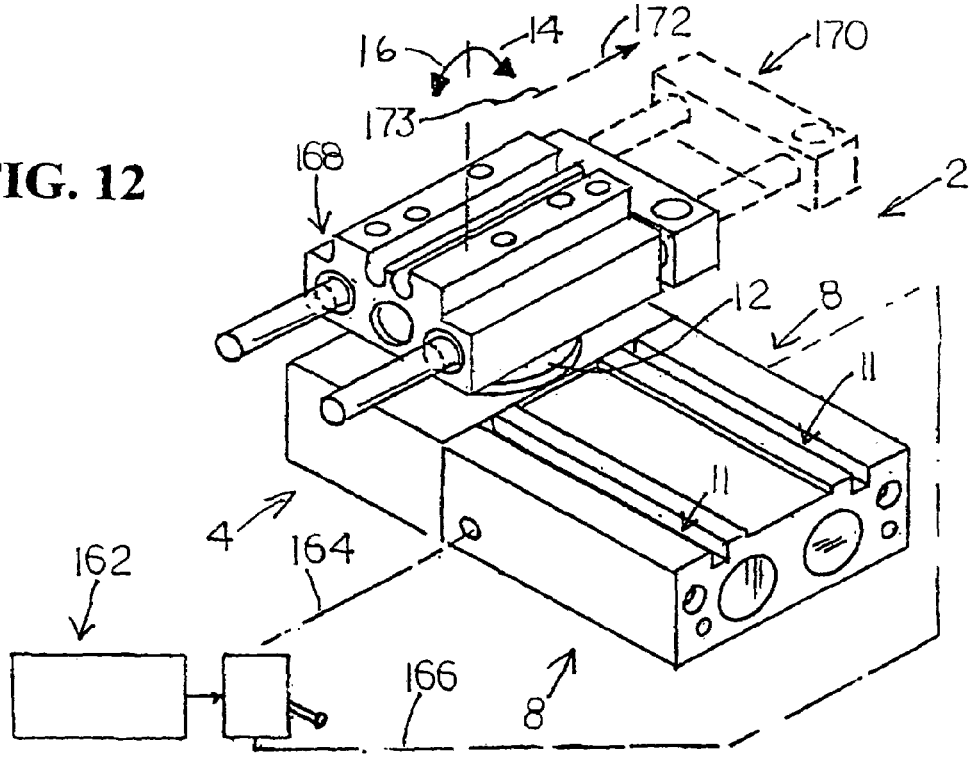

FIGS. 11 and 12 show an illustrative utility of rotary actuator assembly 2. In FIG. 11, a pneumatic power supply 162 provides fluids through tubes 164 and 166 into cap assembly 8 to cause pinion assembly 6 to rotate in either direction 14 or 16. A slide assembly 168 is attached to base 12 of pinion assembly 6 for rotating assembly 168 in directions 14 or 16. In the illustrated embodiments, FIG. 12 shows that slide assembly 168 can be selectively rotated in directions 14 and 16 and, at a certain position, a slide member 170 can be engaged to move in either direction 172 or 173.

Figure 13:
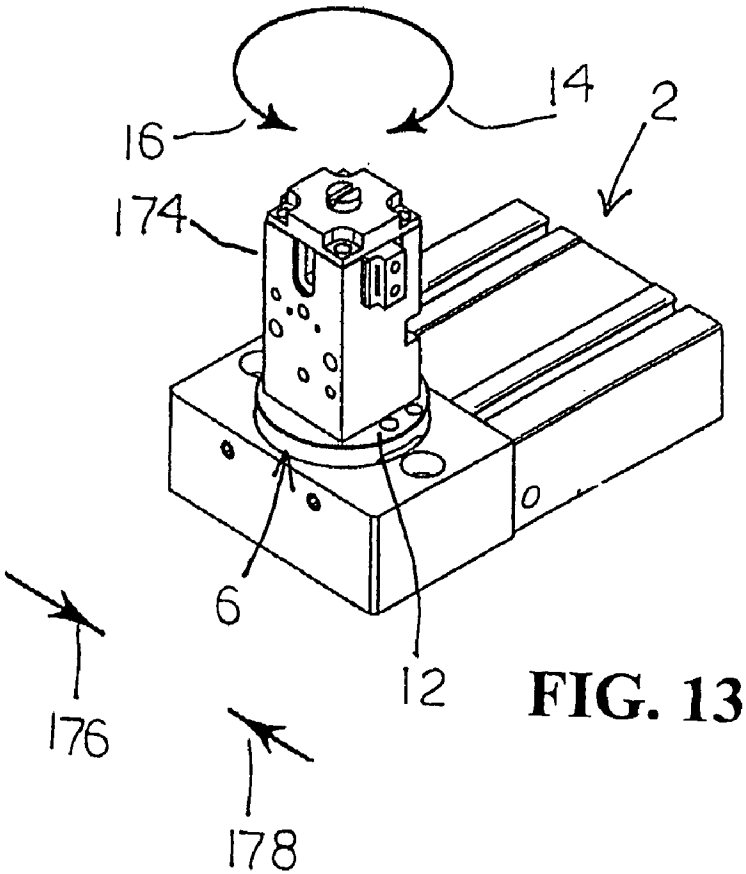
FIGS. 13 and 14 are perspective views of rotary actuator assemblies demonstrating further illustrative utilities thereof.
Figure 14:
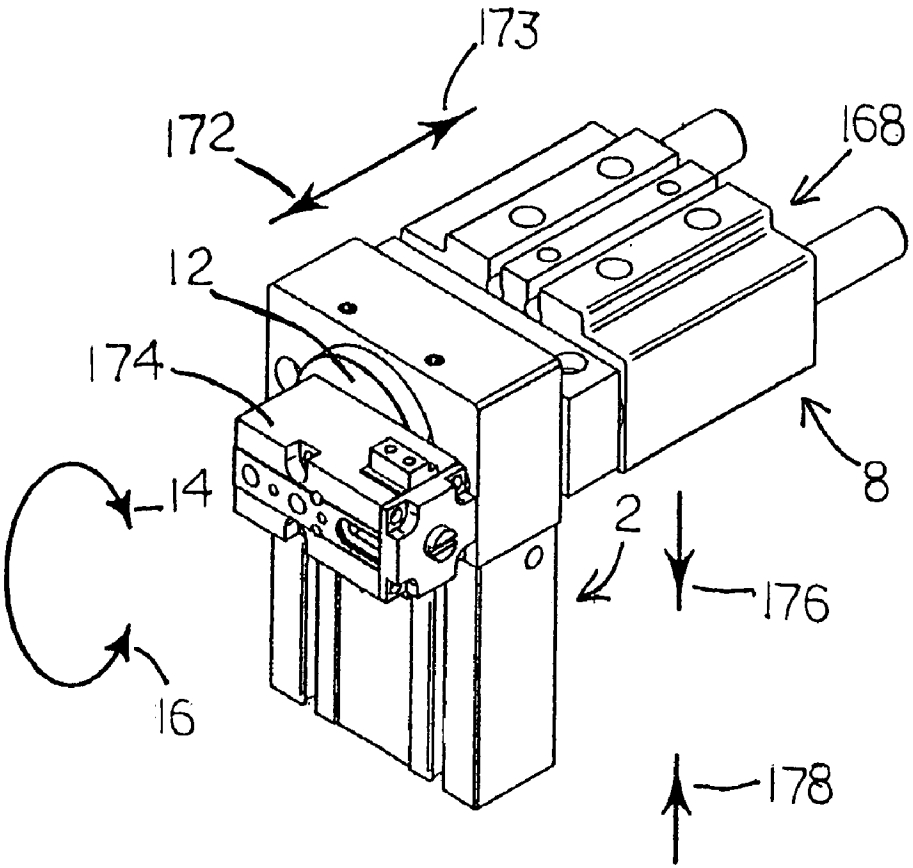

FIGS. 13 and 14 show further illustrative utilities of rotary actuator assembly 2. In FIG. 13, a gripper assembly 174 can be mounted on base 12 of pinion assembly 6 such that the gripper 174 can open and close in directions 176, 178 at a particular rotational position. FIG. 14 also shows a gripper 174 attached to base 12 of a rotary actuator assembly 2. In this configuration, however, the gripper can open and close in a different orientation than shown in FIG. 13. Furthermore, the rotary actuator assembly 2 is itself attached to a slide assembly 168 so that the rotary actuator assembly can rotate gripper assembly 174 at some spaced-apart distance from slide assembly 168.

Although the present disclosure has been described with reference to particular means, materials and embodiments, from the foregoing description, one skilled in the art can easily ascertain the essential characteristics of the present disclosure and various changes and modifications may be made to adapt the various uses and characteristics without departing from the spirit and scope of the present invention as set forth in the following claims.

What is claimed is:

1. A rotary actuator assembly comprising:
- a power supply;
- first and second pistons each movable in response to the supply of power;
- a body with a cavity disposed therein;
- a single rotating element, a portion of which is located interior of the body in the cavity;
- at least one seal located between the power supply and the single rotating element to prevent fluid communication therebetween;
- a first cable portion attached to the first piston and the single rotating element; and
- a second cable portion attached to the second piston and the single rotating element;
- wherein the single rotating element pivots about an axis in response to movement by the first and second pistons;
- wherein the single rotating element comprises a base that is located at least partially exterior of the body; and
- wherein the base is configured to receive an attachment that is pivotable about the axis.

2. The rotary actuator assembly of claim 1, wherein the base comprises a top surface which is located fully exterior of the body.

3. The rotary actuator assembly of claim 1, wherein the power supply is pneumatic.

4. The rotary actuator assembly of claim 1, wherein the attachment is located exterior of the body.

5. The rotary actuator assembly of claim 1, wherein the attachment is a pneumatic device.

6. The rotary actuator assembly of claim 1, wherein the attachment is a gripper.

7. The rotary actuator assembly of claim 1, wherein the base further comprises at least one bore spaced apart from the axis and used to receive the attachment.

8. A rotary actuator assembly comprising:
- a power supply;
- first and second pistons each movable in response to the supply of power;
- a longitudinally-extending flexible member attached to the first and second pistons;
- a body with a cavity disposed therein;
- a single rotating element located in the body in the cavity; and
- at least one seal located between the power supply and the single rotating element to prevent fluid communication therebetween;
- wherein the flexible member is attached to the single rotating element and a portion of the flexible member is located in the body;
- wherein the flexible member is disposed through the at least one seal;
- wherein the single rotating element pivots about an axis in response to movement by the first and second pistons;
- wherein the single rotating element comprises a base that at least partially exposed exteriorly of the body; and
- wherein the base is configured to receive an attachment that is pivotable about the axis.

9. The rotary actuator assembly of claim 8, wherein the base comprises a top surface which is exposed to the exterior of the body.

10. The rotary actuator assembly of claim 8, wherein the attachment is located exterior of the body.

11. The rotary actuator assembly of claim 8, wherein the flexible member is a cable.

12. A rotary actuator assembly comprising:
- a power supply;
- at least one piston movable in response to the supply of power;
- a housing within which the at least one piston is located;
- a body with a cavity disposed therein;
- a single rotating element at least a portion of which is located in the body in the cavity;
- a longitudinally-extending flexible member attached to the at least one piston and to the single rotating element, and extends from the body to and into the housing;
- wherein the single rotating element comprises a base that at least partially exposed exterior of the body; and
- at least one seal located between the housing and the body to prevent communication therebetween.

13. The rotary actuator assembly of claim 12, wherein the base comprises a top surface which is configured to receive an attachment that is pivotable with respect to the body.

14. The rotary actuator assembly of claim 12, wherein base further comprises a stop member that extends from the base and into the body to limit movement of the single rotating element.

15. The rotary actuator assembly of claim 12, wherein the flexible member is a cable.

* * * * *